US009391391B2

(12) United States Patent
Chien et al.

(10) Patent No.: US 9,391,391 B2
(45) Date of Patent: Jul. 12, 2016

(54) WATERPROOF ELECTRICAL CONNECTOR

(71) Applicant: Advanced-Connectek Inc., New Taipei (TW)

(72) Inventors: Ming-Lung Chien, New Taipei (TW); Ming-Yung Chang, New Taipei (TW); Zhong-Wu Zhu, Shen-Zhen (CN)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/663,519

(22) Filed: Mar. 20, 2015

(65) Prior Publication Data

US 2015/0325944 A1 Nov. 12, 2015

(30) Foreign Application Priority Data

May 6, 2014 (CN) ..... 2014 1 0186738

(51) Int. Cl.

| | |
|---|---|
| ***H01R 13/52*** | (2006.01) |
| ***H01R 24/66*** | (2011.01) |
| *H01R 12/72* | (2011.01) |
| *H01R 13/516* | (2006.01) |

(52) U.S. Cl.

CPC ..... *H01R 13/5219* (2013.01); *H01R 13/5202* (2013.01); *H01R 24/66* (2013.01); *H01R 12/725* (2013.01); *H01R 13/516* (2013.01)

(58) Field of Classification Search

CPC ..... H01R 13/5202; H01R 13/52; H01R 13/64

USPC ..... 439/271

See application file for complete search history.

(56) References Cited

U.S. PATENT DOCUMENTS

| | | | | |
|---|---|---|---|---|
| 5,022,874 | A * | 6/1991 | Lostumo | H01J 29/925 439/275 |
| 5,356,308 | A * | 10/1994 | Toba | H01R 13/5219 439/422 |
| 7,320,618 | B2 * | 1/2008 | Tsai | H01R 12/716 439/541.5 |
| 8,262,414 | B1 * | 9/2012 | Li | H01R 13/6273 439/607.35 |
| 8,337,244 | B2 * | 12/2012 | Sawamura | H01R 13/5208 439/271 |
| 8,808,035 | B2 * | 8/2014 | Wu | H01R 24/58 439/668 |
| 8,882,515 | B2 * | 11/2014 | Lv | H01R 13/6581 439/607.35 |
| 8,956,187 | B2 * | 2/2015 | He | H01R 13/504 439/607.35 |
| 9,112,296 | B2 * | 8/2015 | Zhang | H01R 13/516 |
| 9,112,299 | B2 * | 8/2015 | Lu | H01R 13/5227 |
| 2012/0108095 | A1 * | 5/2012 | Liu | H01R 13/5219 439/271 |

(Continued)

*Primary Examiner* — Tulsidas C Patel
*Assistant Examiner* — Peter G Leigh

(57) ABSTRACT

This invention is related to a waterproof electrical connector which comprises an insulation body, a metal shell, a plurality of terminals, a waterproof rubber, and a waterproof rubber ring. The insulation body includes a rubber core portion and a tongue plate portion, the tongue plate portion extending outward from the rubber core portion. The metal shell surrounds the insulation body and forms a receiving cavity, wherein the metal shell is a seamless structure. These terminals are fixed in the rubber core portion, one end of the terminals is located in the tongue plate portion, and the other end of the terminals pierces through the side of the rubber core portion away from the tongue plate portion. The waterproof rubber is located at the side of the rubber core portion away from the tongue plate portion, and stuck to the metal shell, the rubber core portion, and these terminals. And the waterproof rubber ring surrounds the front end of the metal shell. Compared to the prior art, this invention of the waterproof electrical connector not only has the smaller whole volume, but also has the higher strength, is not easy to be deformed, and is more durable.

14 Claims, 6 Drawing Sheets

(56) References Cited

U.S. PATENT DOCUMENTS

2014/0087576 A1* 3/2014 Kuo ..... H01R 13/5202 439/271
2014/0127923 A1* 5/2014 Kuo ..... H01R 13/5202 439/271
2014/0302709 A1* 10/2014 Zhao ..... H01R 12/57 439/519
2015/0194761 A1* 7/2015 Xie ..... H01R 24/60 439/521
2015/0270639 A1* 9/2015 Yu ..... H01R 13/5219 439/271

* cited by examiner

WATERPROOF ELECTRICAL CONNECTOR

BACKGROUND OF THE INVENTION

1. Field of the Invention

The present invention relates to an electrical connector, and more particularly to a waterproof electrical connector.

2. Description of the Prior Art

In the prior art, there is a waterproof portable electronic device, e.g., the smart phone, on which the electrical connector also can achieve a waterproof effect to avoid the water infiltrating from the gap in the electrical connector of the electronic device. The conventional waterproof electrical connector comprises an insulation body, a metal shell, a plastic shell, and a plurality of terminals. The insulation body includes the rubber core portion, and the tongue plate portion extending from the rubber core; the metal shell that surrounds the rubber core and the tongue plate portion forms receiving cavity. These terminals are fixed in the rubber core and positioned at the tongue plate portion. The plastic shell then further surrounds the outside of the metal shell.

The metal shell is produced by bending the metal plate to form the shape. In general, there are four times of bending to form a generally rectangular sample. The head and the tail of the metal plate will be connected after bending, while the connecting of the head and the tail is a general contacting and is hard to avoid from generating a gap which insults in the water infiltrating. Therefore, in order to achieve the waterproof effect in the prior art, the plastic shell is added on the outside of the metal shell. By the second layer structure formed by the plastic shell, the gap of the metal is sealed. However, such existing electrical connector is made of a metal shell with a plastic shell, the thickness of the shell definitely increase, and the whole volume also increase. Such kind design is diametrically opposed to the light-thin trend of the portable electronic devices.

SUMMARY OF THE INVENTION

In view of this, the object of the invention is to provide a waterproof electrical connector to reduce the thickness and the whole volume of itself, and, when applied to the waterproof portable electronic devices, it does not violet the requirement of the light-thin design.

To achieve the above object, the present invention provides a waterproof electrical connector which comprises an insulation body, a metal shell, a plurality of terminals, a waterproof rubber, and a waterproof rubber ring. The insulation body includes a rubber core portion and a tongue plate portion, the tongue plate portion extends outward from the rubber core portion. The metal shell surrounds the insulation body and forms a receiving cavity, and the metal shell is a seamless structure. These terminals are fixed in the rubber core portion, one end of these terminals is located in the tongue plate portion, and the other end of these terminals pierces through the side of the rubber core portion away from the tongue plate portion. The waterproof rubber is located at the side of the rubber core portion away from the tongue plate portion, and stuck to the metal shell, the rubber core portion, and these terminals. The waterproof rubber ring surrounds the front end of the metal shell.

In one embodiment of the invention, the metal shell is a metal injection molded piece.

In one embodiment of the invention, the metal shell includes four plates, these plates that seamlessly connect to each other and form the receiving cavity.

In one embodiment of the invention, the side of the rubber core portion away from the tongue plate portion and the inside of the rear end of the metal shell together form a recess, the waterproof rubber is located in the recess and fills the recess.

In one embodiment of the invention, the metal shell comprises a stopper which extends to the recess, and the waterproof rubber is stuck to the stopper.

In one embodiment of the invention, the waterproof electrical connector further comprises a rubber tape, wherein the stopper is formed by inward bending the rear end of the metal shell toward the recess to form a gap.

In one embodiment of the invention, the waterproof electrical connector further comprises a metal plate, and the metal plate is attached to the side of the tongue plate portion away from these terminals.

In one embodiment of the invention, the tongue plate portion includes a first tongue plate portion and a second tongue plate portion, the second tongue plate portion extends outward from the rubber core portion, the first tongue plate portion extends outward from the second tongue plate portion, these terminals include a first terminals and a second terminals, one end of the second terminals is located at the second tongue plate portion, one end of the first terminals is located at the first tongue plate portion.

The metal shell of the waterproof electrical connector proposed by the present invention is seamlessly connected, therefore the metal shell has no gap. And thus there is no need to additionally add a layer of plastic shell, the waterproof effect can just be achieved, therefore the thickness and the whole volume of the shell can be reduced. In addition, the metal shell of the present invention is produced by metal injection molding; the strength of the shell of the metal injection molding is higher than that of the shell formed by bending. Compared with the prior art, the present invention of the waterproof electrical connector not only has a smaller volume and higher strength, but also is not easy to be deformed and is more durable. The proposed invention of a waterproof electrical connector, its metal casing itself based seamless connection, and therefore does not have a slit, no need to additionally add a layer of plastic casing, can achieve the effect of water, thereby reducing the thickness and overall size of the housing, in addition, the metal shell of the system of the present invention produced using a metal injection molding, metal injection molding of the casing strength will be higher than the bending shape.

To make the purpose, the features, and the advantages of this present invention easier to be comprehended by those who have the general knowledge in the field, the following text provides a preferred embodiment with the accompanying drawings to describe in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

The FIG. 1 is a schematic diagram of one preferred embodiments of the waterproof electrical connector of the present invention.

Figure 2:
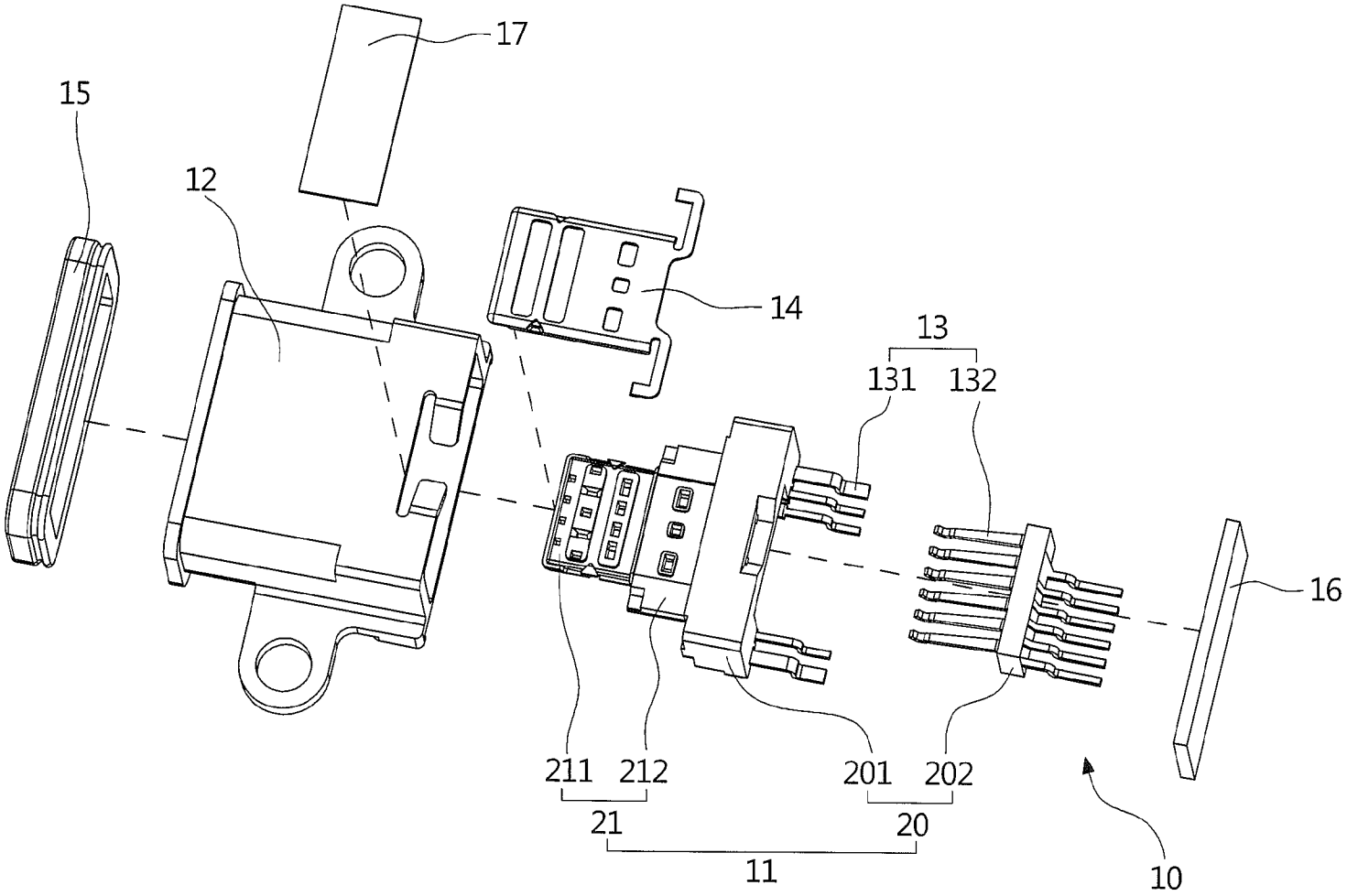

The FIG. 2 is an exploded schematic diagram of one preferred embodiments of the waterproof electrical connector of the present invention.

Figure 3:
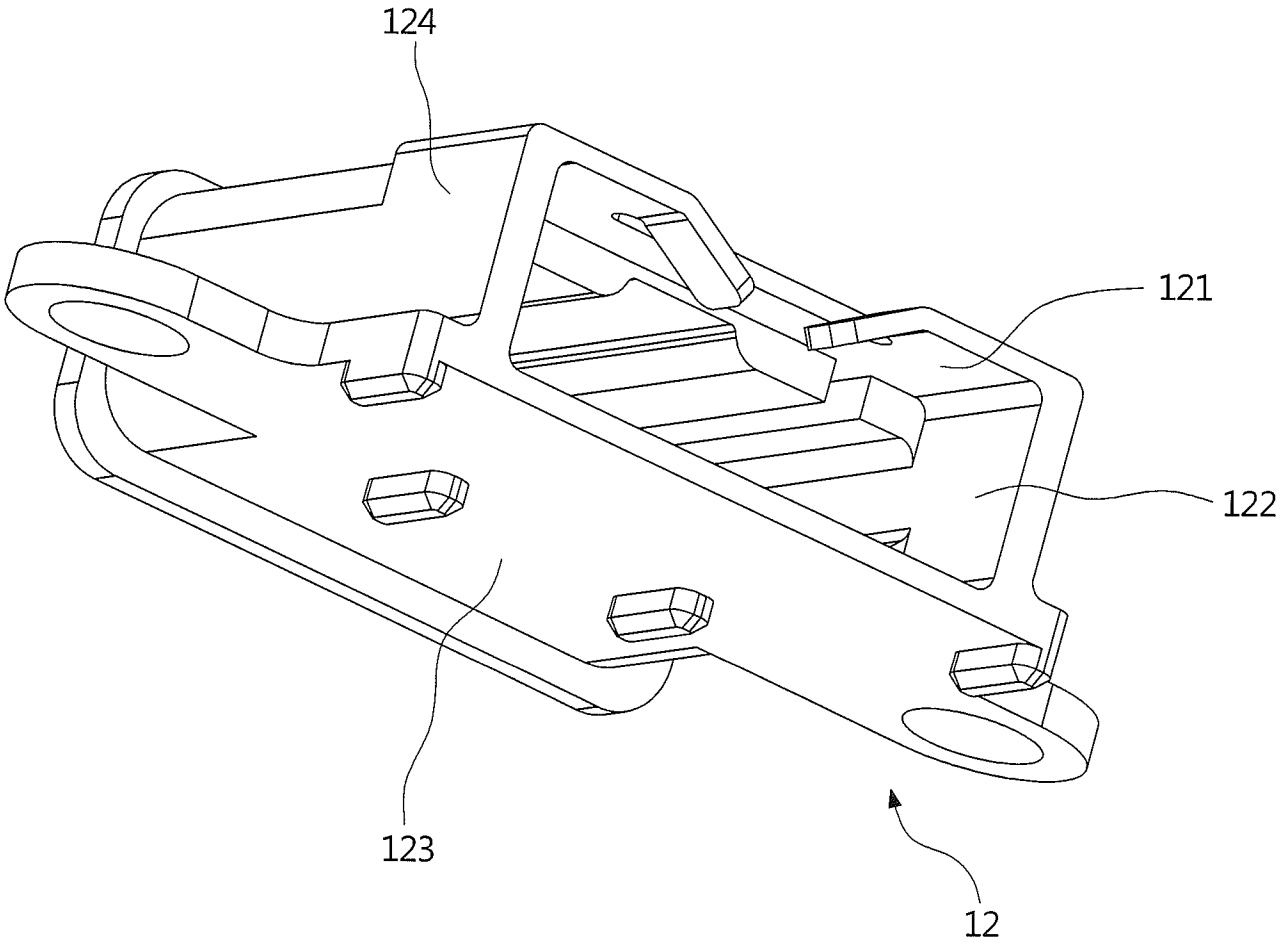

The FIG. 3 is a schematic diagram of one preferred embodiments of the metal shell of the present invention.

Figure 4:
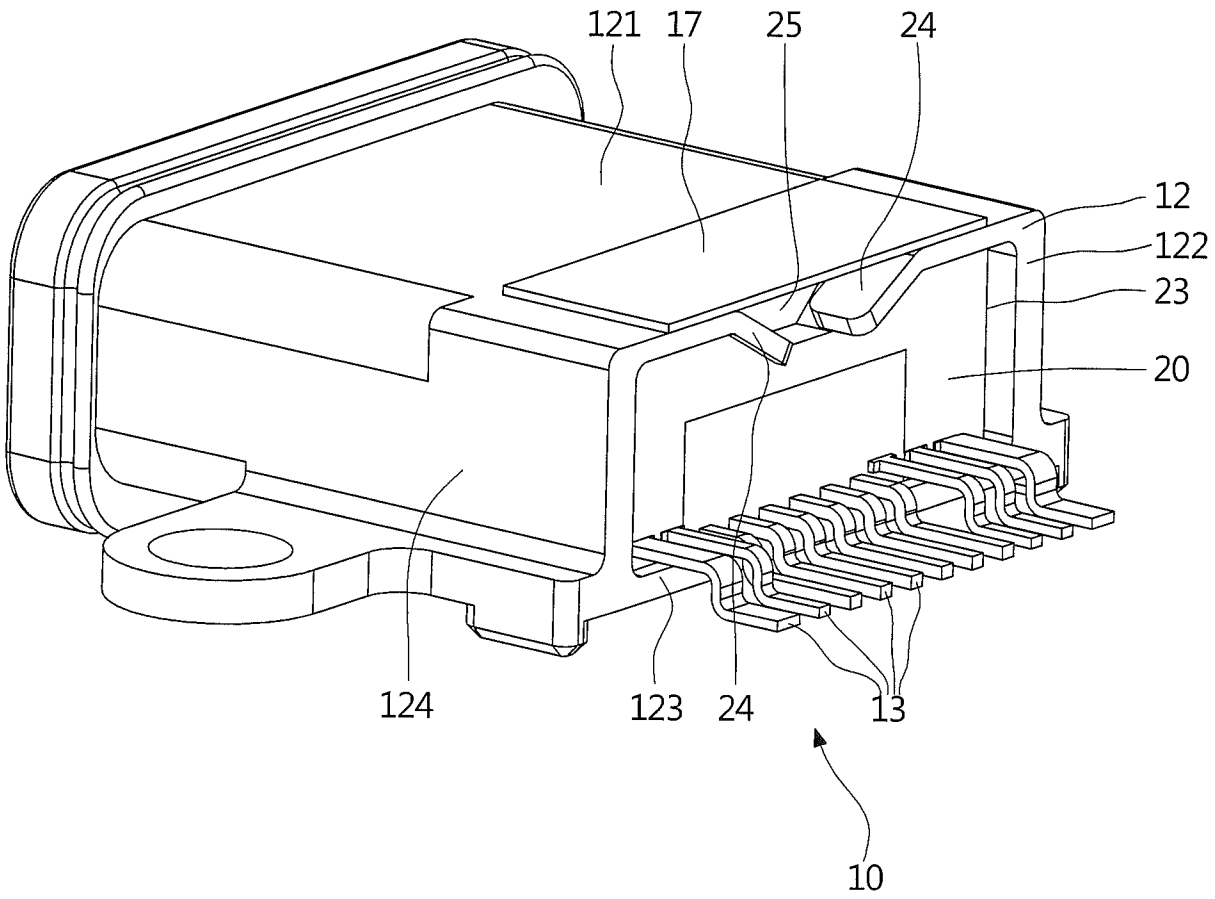

The FIG. 4 is the schematic diagram of one preferred embodiment of the waterproof electrical connector without the waterproof rubber of this present invention.

Figure 5:
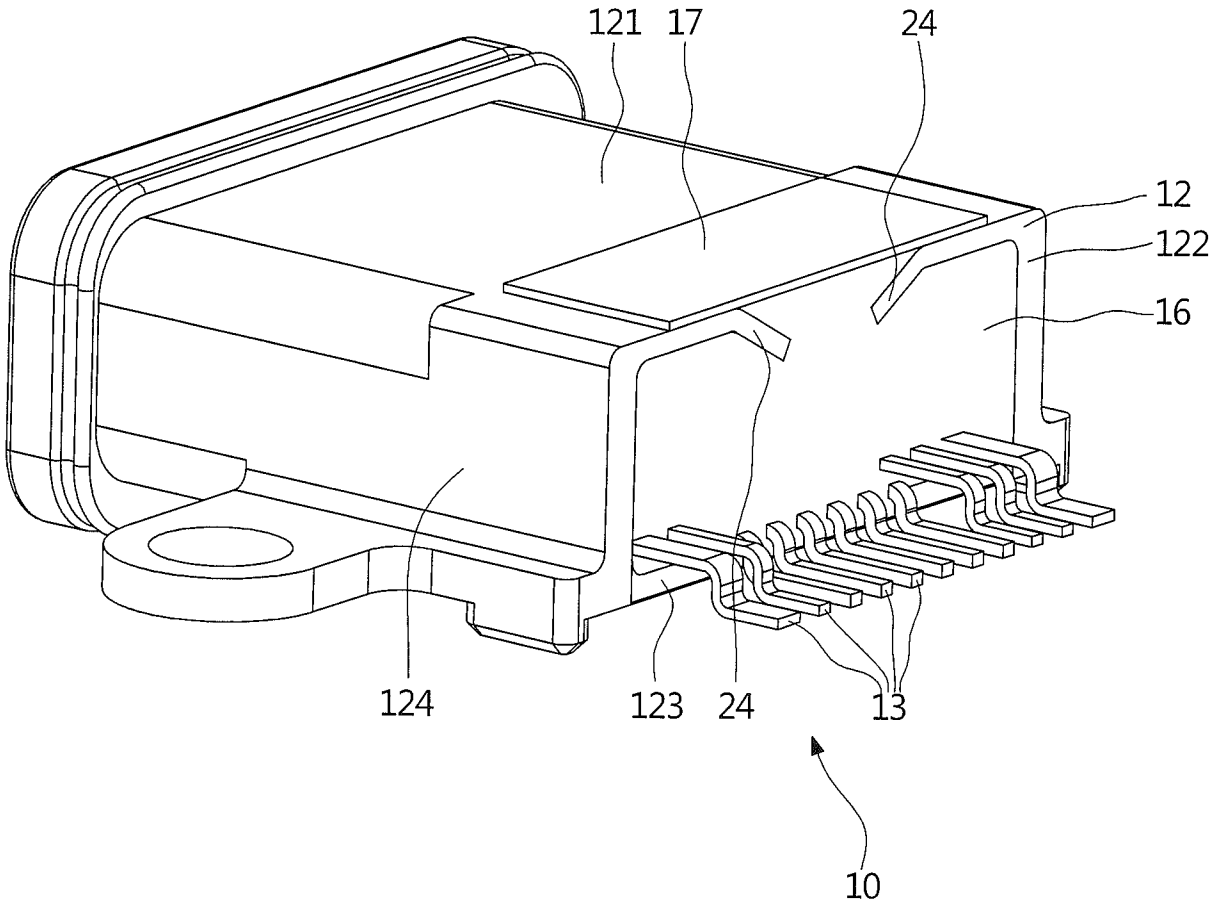

The FIG. 5 is the schematic diagram of one preferred embodiment of the waterproof electrical connector with the waterproof rubber of this present invention.

Figure 6:
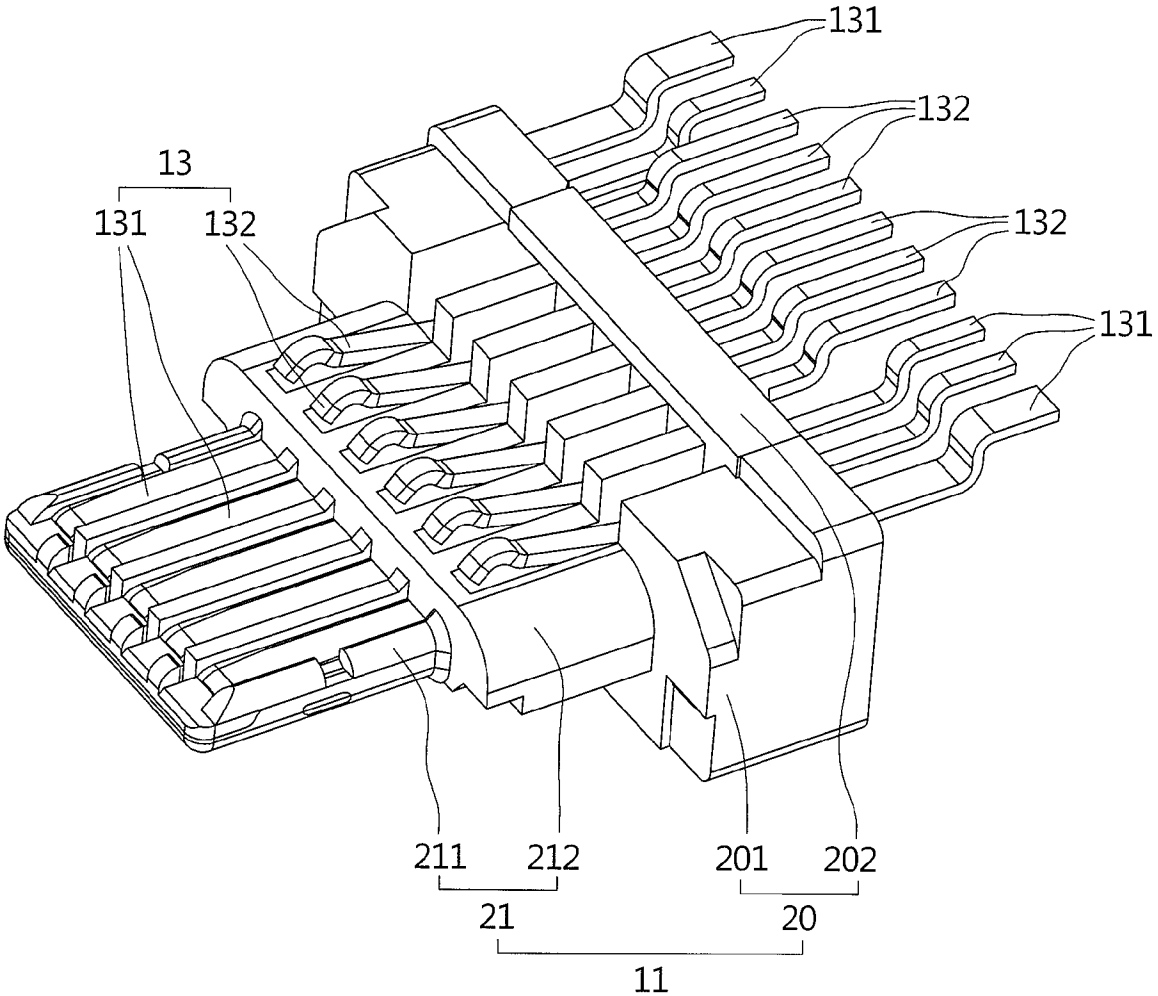

The FIG. 6 is a schematic diagram of the preferred embodiment of the insulation body with these terminals of this present invention.

DESCRIPTION OF THE PREFERRED EMBODIMENTS

Reference will now be made in detail to the preferred embodiments of the present invention, examples of which are illustrated in the accompanying drawings. Wherever possible, the same reference numbers are used in the drawings and the description to refer to the same or like parts.

Figure 1:
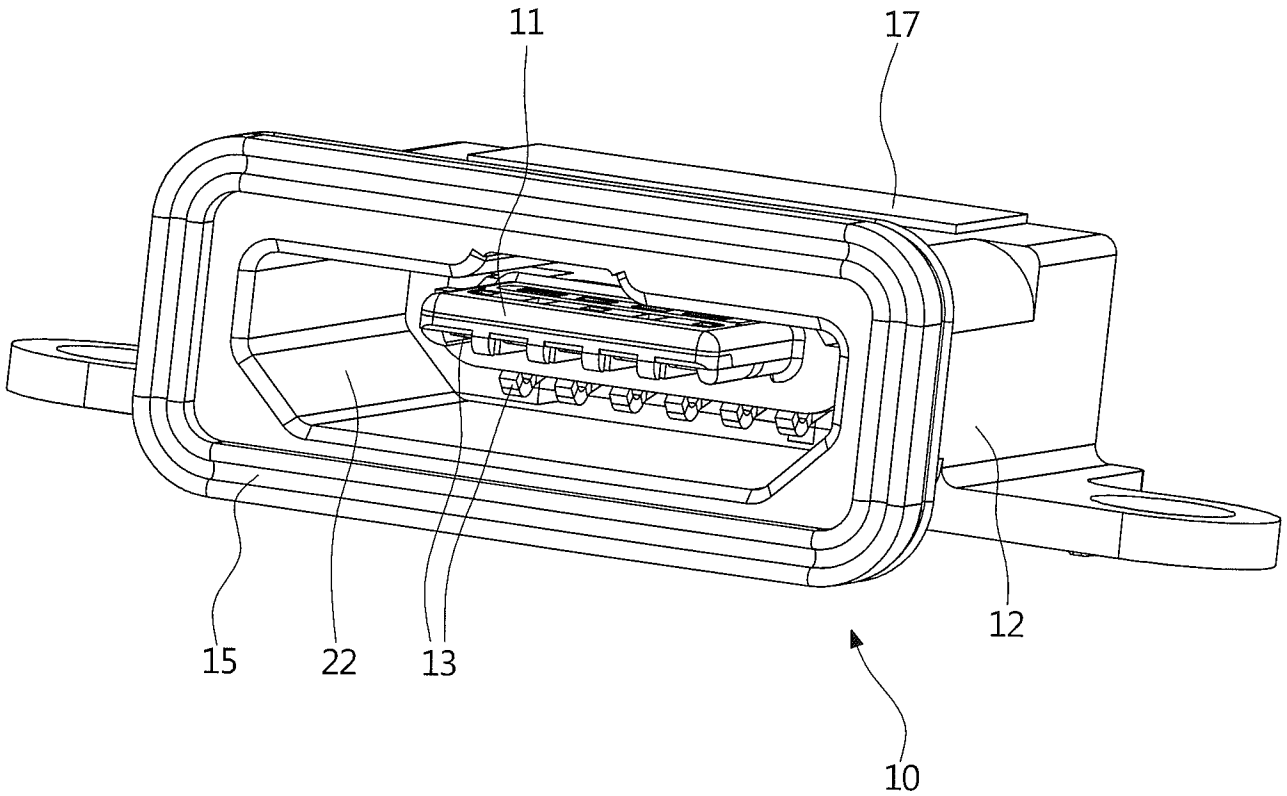

Please refer to FIG. 1 and FIG. 2. The FIG. 1 is a schematic diagram of one preferred embodiments of the waterproof electrical connector of the present invention. The FIG. 2 is an exploded schematic diagram of one preferred embodiments of the waterproof electrical connector of the present invention. This application provides a waterproof electrical connector 10 which has the waterproof function and effect and can be applied to a waterproof portable electronic device (not shown), for example, the waterproof smart phone. In the present embodiment, the waterproof electrical connector 10 is a receptacle connector which conforms to the micro universal serial bus (Micro USB) 2.0 specification, but is not limited thereto.

The waterproof electrical connector comprises an insulation body 11, a metal shell 12, a plurality of terminals 13, a metal plate 14, a waterproof rubber ring 15, a waterproof rubber 16, and a waterproof rubber tape 17. The insulation body 11 includes a rubber core portion 20 and a plate portion 21. The tongue plate portion 21 is extended outwardly from the rubber core portion 20. The metal shell 21 surrounds the insulation body 11 and forms a receiving cavity 22. These terminals 13 are fixed in the rubber core portion 20. The ends of these terminals 13 are located in one side of the tongue plate portion 21, the other ends of these terminals 13 pierce through the side of the rubber core portion 20 away from the tongue plate portion. The metal plate 14 is attached to the other side of the tongue plate portion 21 away from these terminals 13, and inserted into the rubber core portion 20. The metal plate 14 can enhance the whole strength of the tongue plate portion 21 and the rubber core portion 20. The waterproof rubber ring 15 surrounds the front end of the metal shell 12. When the waterproof electrical connector 10 is mounted to the portable electronic device, the waterproof rubber ring 15 can seal the gap between the waterproof electrical connector 10 and the portable electronic device to avoid the water seepage.

Please refer to FIGS. 1~3 at the same time, the FIG. 3 is a schematic diagram of one preferred embodiments of the metal shell of the present invention. The metal shell 12 is seamless structure. In the practice, the metal shell 12 includes four plates 121, 122, 123, 124, these plates 121, 122, 123, 124 that seamlessly connect to each other form a generally rectangular sample. The insides of these plates 121, 122, 123, 124 form the receiving cavity 22. The key point is that there is no gap between the connecting of these four plates 121,122,123, 124, and there is no gap generated by the connecting on these plates 121,122,123,124, as shown in FIG. 1 and FIG. 3. In this embodiment, the metal shell 12 is a metal injection molding (Metal Injection Molding, MIM) piece, that is to say, the metal shell 12 is made by the metal injection molding technology. These plates 121, 122, 123, 124 of the metal shell 12 is made by the metal powder via the injection molding method to form in one piece, there the metal shell 12 of the invention will not has gap formed at the connection of the head and the tail of the metal shell 12 after bending as in the prior art.

Please refer to the FIG. 4, the FIG. 4 is the schematic diagram of one preferred embodiment of the waterproof electrical connector without the waterproof rubber of the present invention. As shown in FIG. 4, the side of the rubber core portion 20 away from the tongue plate portion 21 and the inside of the rear end of these plates 121,122,123,124 of the metal shell 12 form a recess 23, one plate 121 of the metal shell 12 is equipped with a stopper 24 which extends to the recess 23. The stopper 24 is formed by bending inward the rear end of the metal shell 12 toward the recess 23 to form a gap 25. The stopper 24 is pressed against the side of the rubber core portion 20 away from the tongue plate portion 21, when there is a plug plugging into the receiving cavity 22 of the waterproof electrical connector 10, part of the plugging stress can be counteracted by the stopper 24 and the backward movement trend of the insulting body 11 is stopped, so as to avoid the damage of the waterproof electrical connector 10 due to the possible movement of the insulation body 11 after the long term of usage of plug-and-unplug. In the present embodiment, the stopper 24 and the four plates 121,122,123, 124 are integrally formed in one piece by the metal injection molding. In other embodiment, the stopper can be formed, after the forming of these plates 121,122,123,124, by the further cutting.

Please refer to the FIG. 5, the FIG. 5 is the schematic diagram of one preferred embodiment of the waterproof electrical connector with the waterproof rubber of this present invention. As described above, the metal shell 12 is a seamless structure, whereas there is a gap between the metal shell 12 and the insulation body 11. Therefore a waterproof rubber 16 is necessary to be further coated onto the recess 23 when being manufactured. Because of the mentioned gap 25, in order to let the waterproof rubber 16 solidify in the recess 23 and fill the recess 23 rather than leak out from the gap 25, a rubber tape 17 will be attached onto the metal shell 12 first and block the gap 25 in the process. After that, the waterproof rubber 16 is coated onto the recess 23. When the waterproof rubber 16 has solidified, the waterproof rubber 16 will be fixed in the recess 23 and also stuck to the metal shell 12, the stopper 24, the rubber tape 17, the rubber core portion 20, and these terminals 13, which thus fill up the gap 25 between the metal shell 12 and the insulation body 11. With the seamless structure of the metal shell 12 itself as well as the waterproof rubber 16 blocking the seam between the metal shell 12 and the insulation body 11, when the waterproof electrical connector 10 is installed to the mentioned portable electronic device, even if the liquid was poured into the a receiving cavity 22. of the waterproof electrical connector 10, the liquid will not penetrate into the interior space of the portable electronic device.

Please refer to both the FIG. 2 and FIG. 6, the FIG. 6 is a schematic diagram of the preferred embodiment of the insulation body with these terminals of this present invention. The rubber core portion 20 includes a first rubber core 201 and a second rubber core 202. The tongue plate portion 21 includes a first tongue plate portion 211 and a second tongue plate portion 212. The second tongue plate portion 212 extends outwardly from the first rubber core 201. The first tongue plate portion 211 extends outwardly from the second tongue plate portion 212. The second tongue plate portion 212 and the first rubber core 201 locate at different levels to form a height difference between the second tongue plate portion 212 and the rubber core 201. The first tongue plate portion 211 and the second tongue plate portion 212 also locate at different levels to form a height difference between the first tongue plate portion 211 and the second tongue plate portion 212. These terminals 13 include first terminals 131 and second terminals 132. These first terminals 131 are fixed at the first rubber core 201. The ends of the first terminals 131 are located in the first tongue plate portion 211. The second terminals 132 retain in the second rubber core 202. The second rubber core 202 is connected to the first rubber core 201, and the ends of the second terminals 132 are located in the second tongue plate portion 212. The first terminals 131, for example, conform to the Micro USB 2.0 specification, and the second terminals 132 are input/output (Input/Output, I/O) terminals.

The metal shell of the waterproof electrical connector proposed by the present invention is seamlessly connected, therefore the metal shell has no gap. And thus there is no need to additionally add a layer of plastic shell, the waterproof effect and function can just be achieved, therefore the thickness and the whole volume of the shell can be reduced. In addition, the metal shell of the present invention is produced by metal injection molding, the strength of the shell of the metal injection molding is higher than that of the shell formed by bending. Compared with the prior art, the present invention of the waterproof electrical connector not only has a smaller volume and higher strength, but also is not easily deformed and is more durable.

The metal shell of the waterproof electrical connector proposed by the present invention is seamlessly connected, therefore the metal shell has no gap. And thus there is no need to additionally add a layer of plastic shell, the waterproof effect can just be achieved, therefore the thickness and the whole volume of the shell can be reduced. In addition, the metal shell of the present invention is produced by metal injection molding, the strength of the shell of the metal injection molding is higher than that of the shell formed by bending. Compared with the prior art, the present invention of the waterproof electrical connector not only has a smaller volume and higher strength, but also is not easily deformed and is more durable.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

We claim:

1. A waterproof electrical connector, comprising:

an insulation body including a rubber core portion and a tongue plate portion, the tongue plate portion extending outwardly from the rubber core portion;

a metal shell surrounding the insulation body and forming a receiving cavity, wherein the metal shell is a seamless structure;

a plurality of terminals fixed in the rubber core portion, wherein one end of the terminals is located in the tongue plate portion, and the other end of the terminals pierces through a side of the rubber core portion away from the tongue plate portion;

a waterproof rubber located at the side of the rubber core portion away from the tongue plate portion, wherein the waterproof rubber is stuck to the metal shell, the rubber core portion, and the terminals; and a waterproof rubber ring surrounding and directly contacting the front end of the metal shell.

2. The waterproof electrical connector of claim 1, wherein the metal shell is a metal injection molded piece.

3. The waterproof electrical connector of claim 2, wherein the metal shell includes four plates, wherein the plates seamlessly connect to each other and form the receiving cavity.

4. The waterproof electrical connector of claim 2, wherein the side of the rubber core portion away from the tongue plate portion and an inside of the rear end of the metal shell together form a recess, wherein the waterproof rubber is located in the recess and fills the recess.

5. The waterproof electrical connector of claim 4, wherein the metal shell includes a stopper which extends inwardly into the recess, wherein the waterproof rubber is stuck to the stopper.

6. The waterproof electrical connector of claim 5, further comprising a rubber tape, wherein the stopper is formed by bending inward the rear end of the metal shell toward the recess to form a gap.

7. The waterproof electrical connector of claim 1, further comprising a metal plate, wherein the metal plate is attached to the side of the tongue plate portion away from the terminals.

8. The waterproof electrical connector of claim 1, wherein the tongue plate portion includes a first tongue plate portion and a second tongue plate portion, the second tongue plate portion extends outwardly from the rubber core portion, the first tongue plate portion extends outwardly from the second tongue plate portion, the terminals include first terminals and second terminals, one end of the second terminals is located at the second tongue plate portion, and one end of the first terminal is located at the first tongue plate portion.

9. The waterproof electrical connector of claim 6, wherein the waterproof rubber is fixed in the recess and stuck to the metal shell, the stopper, the rubber tape, the rubber core portion and the terminals.

10. The waterproof electrical connector of claim 6, wherein the rubber tape is attached onto the metal shell and blocks the gap.

11. The waterproof electrical connector of claim 10, wherein the waterproof rubber is fixed in the recess and stuck to the metal shell, the stopper, the rubber tape, the rubber core portion and the terminals.

12. The waterproof electrical connector of claim 8, wherein the rubber core portion comprises a first rubber core and a second rubber core, the second rubber core is connected to the first rubber core, and the plurality of terminals comprises first terminals and second terminals, the first terminals are fixed at the first rubber core, one end of each first terminal is located at the first tongue plate portion, the other end of each first terminal pierces through the side of the first rubber core away from the tongue plate portion, the second terminals are retained in the second rubber core, one end of each second terminal is located at the second tongue plate portion, and the other end of each second terminal pierces through the side of the second rubber core away from the tongue plate portion.

13. The waterproof electrical connector of claim 12, wherein the waterproof rubber is fixed in the recess and stuck to the metal shell, the stopper, the rubber tape, the rubber core portion and the terminals.

14. The waterproof electrical connector of claim 13, wherein the rubber tape is attached onto the metal shell and blocks the gap.

* * * * *